US007337810B2

(12) United States Patent
Orr et al.

(10) Patent No.: US 7,337,810 B2
(45) Date of Patent: Mar. 4, 2008

(54) ELASTIC FABRIC WITH SINUSOIDALLY DISPOSED WIRES

(75) Inventors: Lawrence William Orr, Simpsonville, SC (US); Katie Richards Hammett, Piedmont, SC (US); Connie Barnett, Pelzer, SC (US)

(73) Assignee: Woven Electronics Corporation, Simpsonville, SC (US)

( * ) Notice: Subject to any disclaimer, the term of this patent is extended or adjusted under 35 U.S.C. 154(b) by 334 days.

(21) Appl. No.: 11/100,989

(22) Filed: Apr. 7, 2005

(65) Prior Publication Data

US 2006/0228970 A1 Oct. 12, 2006

(51) Int. Cl.

| | |
|---|---|
| ***D03D 11/00*** | (2006.01) |
| ***D03D 11/02*** | (2006.01) |
| ***A41D 27/02*** | (2006.01) |
| *A41D 27/00* | (2006.01) |

(52) U.S. Cl. ..... 139/421; 139/408; 139/420 R; 139/422; 139/423; 139/425 R; 139/426 R; 2/259; 2/272; 2/905

(58) Field of Classification Search ..... 139/408, 139/420 R, 421, 422, 423, 425 R, 426 R
See application file for complete search history.

(56) References Cited

U.S. PATENT DOCUMENTS

| | | | | |
|---|---|---|---|---|
| 857,367 | A | 6/1907 | Shore et al. | |
| 2,327,756 | A * | 8/1943 | Adamson | 219/545 |
| 2,831,235 | A * | 4/1958 | Taylor | 28/155 |
| 3,479,565 | A | 11/1969 | Ross et al. | |
| 3,711,627 | A * | 1/1973 | Maringulov | 174/255 |
| 4,095,042 | A | 6/1978 | Ross | |
| 4,442,314 | A | 4/1984 | Piper | |
| 4,460,803 | A | 7/1984 | Piper | |
| 4,559,411 | A | 12/1985 | Piper | |
| 4,577,256 | A * | 3/1986 | Breidegam | 361/220 |
| 4,654,748 | A * | 3/1987 | Rees | 361/220 |
| 4,664,158 | A | 5/1987 | Sands | |
| 4,746,769 | A | 5/1988 | Piper | |
| 4,808,771 | A | 2/1989 | Orr, Jr. | |
| 4,813,459 | A * | 3/1989 | Breidegam | 139/421 |
| 4,910,358 | A | 3/1990 | Mittelbushe | |
| 5,373,103 | A | 12/1994 | Orr, Jr. | |
| 5,773,762 | A | 6/1998 | Orr | |
| 5,823,232 | A * | 10/1998 | Georgii | 139/383 R |

(Continued)

*Primary Examiner*—Robert H Muromoto, Jr.
(74) *Attorney, Agent, or Firm*—McNair Law Firm, P.A.

(57) ABSTRACT

A fabric for use with a system for monitoring prescribed body functions comprising an elastic fabric, adapted to be carried by a torso, which is stretchable in its longitudinal direction so as to expand and contract in response to body movement and size. The carrier includes at least one conductive and inelastic yarn arranged longitudinally of and located between upper and lower surfaces. The conductive yarn is arranged in sinusoidal configurations longitudinally of the fabric. The conductive yarn breaks through one of the outer surfaces at a selected breakout along the length of the fabric. The conductive yarn is cut to present at least one exposed end above the one outer surface. A monitoring unit, which includes a connector and a sensor, is secured with the one outer surface of the fabric at the breakout with the connector being united with the at least one exposed end of the conductive yarn. The fabric acts to maintain the monitoring unit in a desired stationary position with the body allowing the sensor to sense signals emitted from the torso and transmit these senses signals through the conductive yarns.

34 Claims, 14 Drawing Sheets

U.S. PATENT DOCUMENTS 6,210,771 B1 * 4/2001 Post et al. ..... 428/100
6,289,939 B1 * 9/2001 Mortensen et al. ..... 139/22
6,305,432 B1 * 10/2001 Sacks et al. ..... 139/425 R
6,341,504 B1 1/2002 Istook
6,413,225 B1 7/2002 Sackner et al.
6,551,252 B2 4/2003 Sackner et al.
6,581,212 B1 * 6/2003 Andresen ..... 2/167

* cited by examiner

Harness

| 14 | 13 | 12 | 11 | 10 | 9 | 8 | 7 | 6 | 5 | 4 | 3 | 2 | 1 | |
|---|---|---|---|---|---|---|---|---|---|---|---|---|---|---|
| • | • | • | X | • | • | • | X | • | • | • | • | • | • | 1 |
| • | X | • | X | • | X | • | X | • | X | • | X | • | • | 2 |
| • | X | X | X | • | X | X | X | X | X | X | X | X | X | 3 |
| • | • | • | X | • | • | • | X | • | • | • | • | • | • | 4 |
| • | X | • | X | • | X | • | X | X | • | X | • | X | • | 5 |
| X | X | • | X | X | X | • | X | X | X | X | X | X | X | 6 |
| • | X | • | • | • | X | • | • | • | • | • | • | • | • | 7 |
| • | X | • | • | • | X | • | X | • | X | • | X | • | • | 8 |
| X | X | • | X | X | X | • | X | X | X | X | X | X | X | 9 |
| • | X | • | • | • | X | • | • | • | • | • | • | • | • | 10 |
| • | X | • | X | • | X | • | X | X | • | X | • | X | • | 11 |
| • | X | X | X | • | X | X | X | X | X | X | X | X | X | 12 |
| • | • | • | X | • | • | • | X | • | • | • | • | • | • | 13 |
| • | X | • | X | • | X | • | X | • | X | • | X | • | • | 14 |
| • | X | X | X | • | X | X | X | X | X | X | X | X | X | 15 |
| • | • | • | X | • | • | • | X | • | • | • | • | • | • | 16 |
| • | X | • | X | • | X | • | X | X | • | X | • | X | X | 17 |
| X | X | • | X | X | X | • | X | X | X | X | X | X | X | 18 |
| • | X | • | • | • | X | • | • | • | • | • | • | • | • | 19 |
| • | X | • | X | • | X | • | X | • | X | • | X | • | X | 20 |
| X | X | • | X | X | X | • | X | X | X | X | X | X | X | 21 |
| • | X | • | • | • | X | • | • | • | • | • | • | • | • | 22 |
| • | X | X | X | • | X | • | X | X | • | X | • | X | X | 23 |
| • | X | X | X | • | X | X | X | X | X | X | X | X | X | 24 |
| • | • | • | X | • | • | • | X | • | • | • | • | • | • | 25 |
| • | X | • | X | • | X | • | X | • | X | • | X | • | X | 26 |
| • | X | X | X | • | X | X | X | X | X | X | X | X | X | 27 |
| • | • | • | X | • | • | • | X | • | • | • | • | • | • | 28 |
| • | X | • | X | • | X | • | X | X | • | X | • | X | X | 29 |
| X | X | • | X | X | X | • | X | X | X | X | X | X | X | 30 |
| • | X | • | • | • | X | • | • | • | • | • | • | • | • | 31 |
| • | X | • | X | • | X | • | X | • | X | • | X | • | • | 32 |
| X | X | • | X | X | X | • | X | X | X | X | X | X | X | 33 |
| • | X | • | • | • | X | • | • | • | • | • | • | • | • | 34 |
| • | X | • | X | • | X | • | X | X | • | X | • | X | • | 35 |
| • | X | X | X | • | X | X | X | X | X | X | X | X | X | 36 |
| • | • | • | X | • | • | • | X | • | • | • | • | • | • | 37 |
| • | • | • | X | • | X | • | X | • | X | • | X | • | • | 38 |
| • | X | X | X | • | X | X | X | X | X | X | X | X | X | 39 |
| • | • | • | X | • | • | • | X | • | • | • | • | • | • | 40 |
| • | X | • | X | • | X | • | X | X | • | X | • | X | • | 41 |
| X | X | • | X | X | X | • | X | X | X | X | X | X | X | 42 |
| • | X | • | • | • | X | • | • | • | • | • | • | • | • | 43 |
| • | X | • | X | • | X | • | X | • | X | • | X | • | • | 44 |
| X | X | • | X | X | X | • | X | X | X | X | X | X | X | 45 |
| • | X | • | • | • | X | • | • | • | • | • | • | • | • | 46 |
| • | X | • | X | • | X | • | X | X | • | X | • | X | X | 47 |
| • | X | X | X | • | X | X | X | X | X | X | X | X | X | 48 |
| • | • | • | X | • | • | • | X | • | • | • | • | • | • | 49 |
| • | X | • | X | • | X | • | X | • | X | • | X | • | X | 50 |
| • | X | X | X | • | X | X | X | X | X | X | X | X | X | 51 |
| • | • | • | X | • | • | • | X | • | • | • | • | • | • | 52 |
| X | X | • | X | • | X | • | X | X | • | X | • | X | X | 53 |
| X | X | • | X | X | X | • | X | X | X | X | X | X | X | 54 |
| • | X | • | • | • | X | • | • | • | • | • | • | • | • | 55 |
| • | X | • | X | • | X | • | X | • | X | • | X | • | X | 56 |
| X | X | • | X | X | X | • | X | X | X | X | X | X | X | 57 |
| • | X | • | • | • | X | • | • | • | • | • | • | • | • | 58 |
| • | X | • | X | • | X | • | X | X | • | X | • | X | X | 59 |
| • | X | X | X | • | X | X | X | X | X | X | X | X | X | 60 |
| 14 | 13 | 12 | 11 | 10 | 9 | 8 | 7 | 6 | 5 | 4 | 3 | 2 | 1 | |

Picks

*Fig. 2*

Harness

| 14 | 13 | 12 | 11 | 10 | 9 | 8 | 7 | 6 | 5 | 4 | 3 | 2 | 1 | |
|---|---|---|---|---|---|---|---|---|---|---|---|---|---|---|
| • | • | • | X | • | • | • | X | • | • | • | • | • | • | 1 |
| • | X | • | X | • | X | • | X | • | X | • | X | • | • | 2 |
| • | X | X | X | • | X | X | X | X | X | X | X | X | X | 3 |
| • | • | • | X | • | • | • | X | • | • | • | • | • | • | 4 |
| • | X | • | X | • | X | • | X | X | • | X | • | X | • | 5 |
| X | X | • | X | X | X | • | X | X | X | X | X | X | X | 6 |
| • | X | • | • | • | X | • | • | • | • | • | • | X | • | 7 |
| • | X | • | • | • | X | • | X | • | X | • | X | X | • | 8 |
| X | X | • | X | X | X | • | X | X | X | X | X | X | X | 9 |
| • | X | • | • | • | X | • | • | • | • | • | • | X | • | 10 |
| • | X | • | X | • | X | • | X | X | • | X | • | X | • | 11 |
| • | X | X | X | • | X | X | X | X | X | X | X | X | X | 12 |
| • | • | • | X | • | • | • | X | • | • | • | • | X | • | 13 |
| • | X | • | X | • | X | • | X | • | X | • | X | X | • | 14 |
| • | X | X | X | • | X | X | X | X | X | X | X | X | X | 15 |
| • | • | • | X | • | • | • | X | • | • | • | • | X | • | 16 |
| • | X | • | X | • | X | • | X | X | • | X | • | X | X | 17 |
| X | X | • | X | X | X | • | X | X | X | X | X | X | X | 18 |
| • | X | • | • | • | X | • | • | • | • | • | • | X | • | 19 |
| • | X | • | X | • | X | • | X | • | X | • | X | X | X | 20 |
| X | X | • | X | X | X | • | X | X | X | X | X | X | X | 21 |
| • | X | • | • | • | X | • | • | • | • | • | • | X | • | 22 |
| • | X | X | X | • | X | • | X | X | • | X | • | X | X | 23 |
| • | X | X | X | • | X | X | X | X | X | X | X | X | X | 24 |
| • | • | • | X | • | • | • | X | • | • | • | • | X | • | 25 |
| • | X | • | X | • | X | • | X | • | X | • | X | X | X | 26 |
| • | X | X | X | • | X | X | X | X | X | X | X | X | X | 27 |
| • | • | • | X | • | • | • | X | • | • | • | • | X | • | 28 |
| • | X | • | X | • | X | • | X | X | • | X | • | X | X | 29 |
| X | X | • | X | X | X | • | X | X | X | X | X | X | X | 30 |
| • | X | • | • | • | X | • | • | • | • | • | • | • | • | 31 |
| • | X | • | X | • | X | • | X | • | X | • | X | • | • | 32 |
| X | X | • | X | X | X | • | X | X | X | X | X | X | X | 33 |
| • | X | • | • | • | X | • | • | • | • | • | • | • | • | 34 |
| • | X | • | X | • | X | • | X | X | • | X | • | X | • | 35 |
| • | X | X | X | • | X | X | X | X | X | X | X | X | X | 36 |
| • | • | • | X | • | • | • | X | • | • | • | • | • | • | 37 |
| • | • | • | X | • | X | • | X | • | X | • | X | • | • | 38 |
| • | X | X | X | • | X | X | X | X | X | X | X | X | X | 39 |
| • | • | • | X | • | • | • | X | • | • | • | • | • | • | 40 |
| • | X | • | X | • | X | • | X | X | • | X | • | X | • | 41 |
| X | X | • | X | X | X | • | X | X | X | X | X | X | X | 42 |
| • | X | • | • | • | X | • | • | • | • | • | • | • | • | 43 |
| • | X | • | X | • | X | • | X | • | X | • | X | • | • | 44 |
| X | X | • | X | X | X | • | X | X | X | X | X | X | X | 45 |
| • | X | • | • | • | X | • | • | • | • | • | • | • | • | 46 |
| • | X | • | X | • | X | • | X | X | • | X | • | X | X | 47 |
| • | X | X | X | • | X | X | X | X | X | X | X | X | X | 48 |
| • | • | • | X | • | • | • | X | • | • | • | • | • | • | 49 |
| • | X | • | X | • | X | • | X | • | X | • | X | • | X | 50 |
| • | X | X | X | • | X | X | X | X | X | X | X | X | X | 51 |
| • | • | • | X | • | • | • | X | • | • | • | • | • | • | 52 |
| X | X | • | X | • | X | • | X | X | • | X | • | X | X | 53 |
| X | X | • | X | X | X | • | X | X | X | X | X | X | X | 54 |
| • | X | • | • | • | X | • | • | • | • | • | • | • | • | 55 |
| • | X | • | X | • | X | • | X | • | X | • | X | • | X | 56 |
| X | X | • | X | X | X | • | X | X | X | X | X | X | X | 57 |
| • | X | • | • | • | X | • | • | • | • | • | • | • | • | 58 |
| • | X | • | X | • | X | • | X | X | • | X | • | X | X | 59 |
| • | X | X | X | • | X | X | X | X | X | X | X | X | X | 60 |
| 14 | 13 | 12 | 11 | 10 | 9 | 8 | 7 | 6 | 5 | 4 | 3 | 2 | 1 | |

Picks

*Fig. 2A*

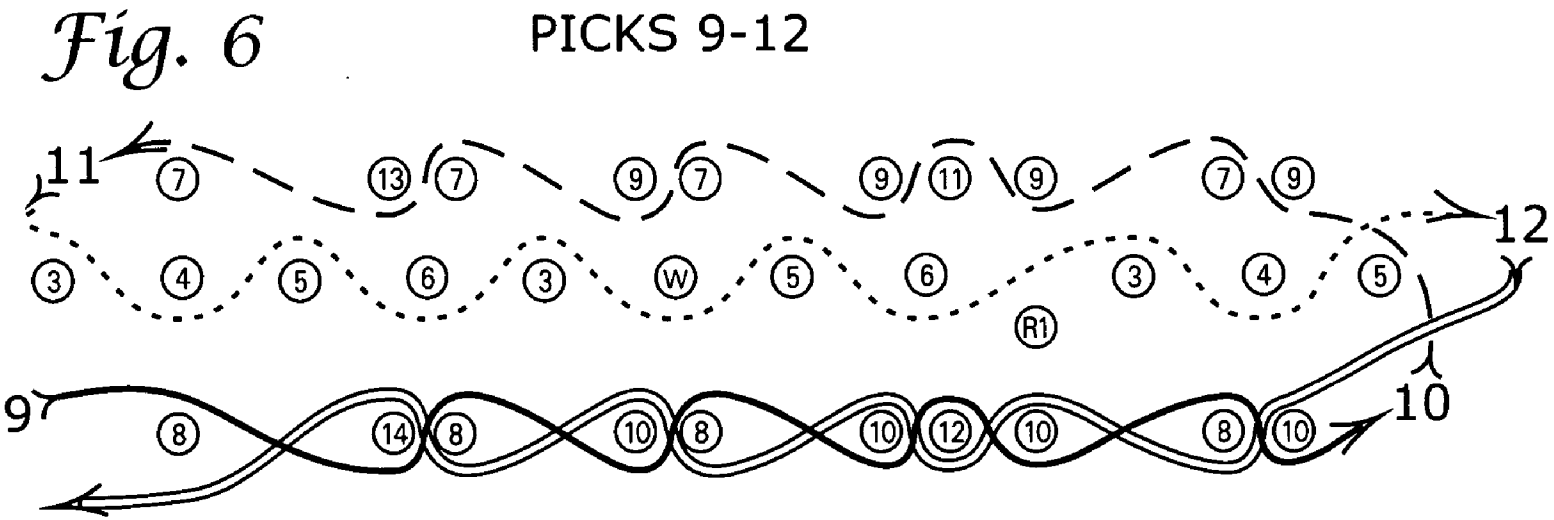
Fig. 6 PICKS 9-12
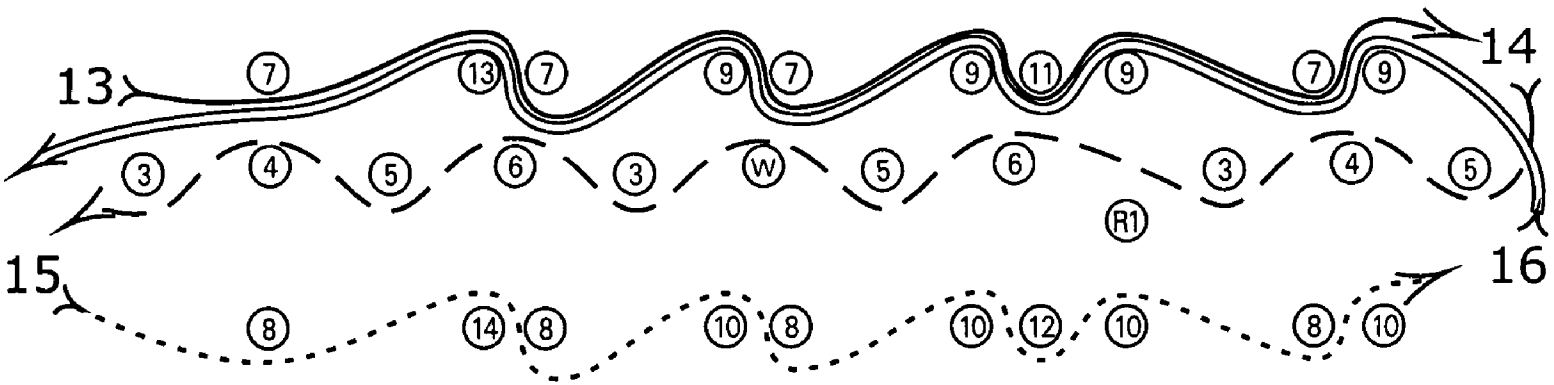
Fig. 7 PICKS 13-16

PICKS 17-20

PICKS 21-24

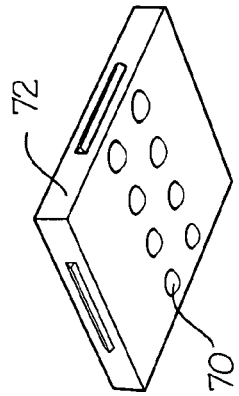
Fig. 20B
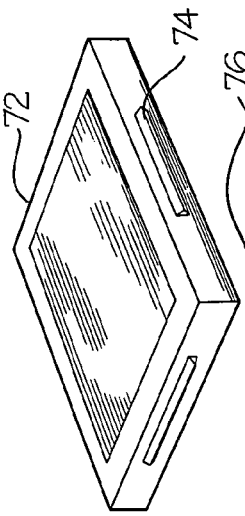
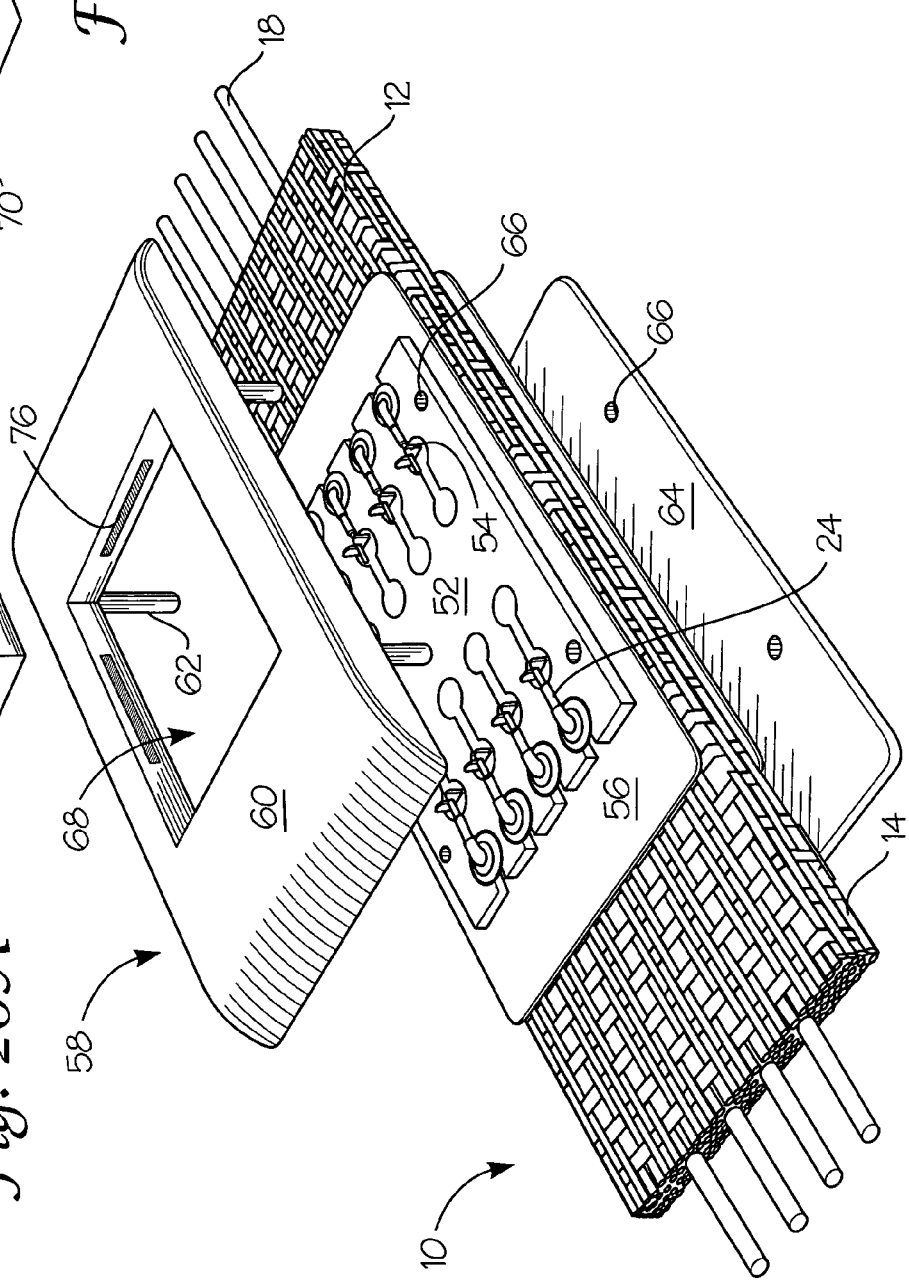
Fig. 20A

ELASTIC FABRIC WITH SINUSOIDALLY DISPOSED WIRES

This application is related to provisional application 60/635,496, filed Dec. 13, 2004, and claims priority of all common subject matter therein.

BACKGROUND OF THE INVENTION

The present invention is directed to woven elastic fabrics which include one or more conductive wires and which are designed to carry systems which monitor selected prescribed body functions.

Elastic fabrics designated to carry monitoring devices are known in the art, as illustrated by U.S. Pat. No. 6,551,252. In this patent, there is only one disclosed fabric, i.e. a warp knitted fabric. The patent states that any or all fabric forming modes may be utilized, however, only one is described.

The primary drawback to a knit fabric, as above referred to, is that the conductive yarns can be controlled to lie in only a transverse fabric plane.

In fabrics used for carrying and positioning body function monitoring equipment, it is most desirable and accordingly an object of the invention that the fabric be elastic yet be sufficiently resilient to allow it to be positioned stationarily in a selected position.

Another object of this invention is the provision of a fabric which can be elongated and retracted while maintaining its pre-set position.

Another object of the invention is an elastic fabric which carries conductive yarns in a protected inner fabric plane, but brings the conductive yarns through an outer fabric surface at selected points for engagement with monitoring equipment.

Another object of the invention is the provision of an elastic fabric with a soft fleece-like surface for contact with the body exterior.

Another object of the invention is the provision of an elastic fabric which contains conductive yarns retained in adjustable sinusoidal configurations within longitudinally extending inner cells of the fabric.

Another object of the invention is an elastic fabric which controls the formation of conductive yarn loops on an outer fabric surface at selected longitudinal intervals.

Another object of the invention is an elastic fabric carrying a monitoring system for sensing signals emitted by a body.

Another object of the invention is a carrier system for securing a sensor with an elastic fabric and with conductive wires carried by that fabric.

SUMMARY OF THE INVENTION

The invention is directed to a carrier fabric for use with a monitoring system for monitoring selected body functions. The fabric could also be utilized for EMI shielding purposes. The fabric comprises an elastic multi-ply woven fabric which is stretchable from a retracted position into a plurality of elongated positions and includes a plurality of upper and lower elastic warp yarns which are arranged in vertically spaced positions forming a plurality of longitudinally extending groups of laterally spaced warp yarns. A plurality of non-elastic picks are woven with the upper and lower warp yarn forming upper and lower outer surfaces. The fabric also includes one or more conductive warp yarns, i.e. fiber, filaments or wire, along with a plurality of core warp yarns and rubber or spandex warp yarns arranged longitudinally of the fabric between the upper and lower surfaces and interwoven with second ones of the picks. The conductive yarn or yarns are in controlled sinusoidal configurations between the upper and lower surfaces while the core and rubber yarns are controlled in expanded or retracted positions. The second ones of the plurality of picks weaving with the conductive warp yarns, the core yarns and the rubber or spandex yarns between the upper and lower outer surfaces position the conductive yarns into the controlled sinusoidal configurations. The fabric may be extended longitudinally between 25 and 125% from its retracted position into various elongated positions causing the controlled sinusoidal configurations of the conductive yarns to be altered consistent with the degree of extension.

The rubber or spandex warp yarns may comprise a spandex core wrapped with a cover of textured polyester or latex. The core may comprise a spandex monofilament of about 420 denier which is wrapped. The cover may comprise a plurality of multi-filament yarns which wrap about the core. The elastic warp yarns preferably comprise textured synthetic yarns.

The conductive yarns are controlled to form one or more of breakout points where the conductive yarns extend through and over a selected length of an outer surface and then back through the outer surface to extend along the intermediate layer of the fabric. Each conductive yarn forms a connector loop over the selected length of the outer surface. Connecter loops may be arranged in transverse rows across the fabric in staggered positions at selected longitudinal locations.

The fabric is preferably woven in a sixty pick repeating pattern and is formed with anywhere between one and twelve conductive warp yarns. The conductive warp yarns are individually located in the cells.

The conductive warp yarn preferably comprises a wire filament core wrapped with textured or non-textured synthetic yarns.

The fabric includes a plurality of elastic edge warp yarns which weave with selected ones of the picks which also weave with the second ones of the picks which also weave with the conductive warp yarns.

The fabric also includes textured binder warp yarns which are arranged to weave between adjacent of the cells with selected of the picks to longitudinally separate the cells.

The second ones of the picks, along with the core warp yarns weave with the conductive yarns and act to bend the conductive yarns in vertical directions creating first ones of the controlled sinusoidal configurations in the conductive yarns which configurations extend generally along a vertical plane.

A method of forming a length of multi-ply elastic fabric for use in a sensing system which includes:

(A) Causing a plurality of first elastic warp yarns to be elongated along first and second vertically spaced planes in a plurality of laterally spaced positions and weaving selected picks of a plurality of picks with the selected warp yarns to form upper and lower surfaces of a multi-layer fabric;

(B) Causing at least one conductive warp yarn, second elastic warp yarns and elastic core warp yarns to extend between the upper and lower surfaces;

(C) Weaving selected other picks, of the plurality of picks, with the second elastic warp yarns, the at least one conductive warp yarn and the elastic core warp yarns shaping the at least one conductive warp yarn into controlled sinusoidal configurations between the upper and lower surfaces;

(D) Causing the elongated elastic warp yarns to contract, reducing the fabric length, causing the sinusoidal configurations to assume enlarged sinusoidal shapes between the upper and lower surfaces.

The method also includes causing the at least one conductive yarn to extend through or to breakout through an outer surface at selected longitudinal points along the fabric length to form loops over the outer surface. The breakout points form connecting points for connecting the conductive yarns with a monitoring system.

A multi-layer carrier fabric for use in a physiological sensing system which includes first, second and third elastic warp yarn groups each interwoven with selected ones of a plurality of picks of inelastic weft yarn through a weave pattern.

A first warp yarn group is controlled to weave with first ones of the picks forming an upper layer or surface. A second warp yarn group is controlled to weave with second ones of the picks forming a lower layer or surface. A third warp yarn group is arranged between the first and second warp yarn groups and is controlled to weave with third ones of the plurality of picks forming an intermediate layer.

The third warp group includes:

(A) An inelastic conductive yarn which is controlled to extend along a sinusoidal path. Core warp yarns which are textured and latex or rubber elastic warp yarns form the remainder of the third warp yarns and weave with weft yarns to shape the conductive warp yarns along the sinusoidal path.

(B) Breakout points are provided where the conductive yarn is controlled to form loops above the upper layer of the fabric.

A system for monitoring prescribed body functions which comprises a carrier worn over a portion of a torso, which includes a composite elastic fabric stretchable in its longitudinal direction so as to expand and contract in response to body movement and size. The carrier includes at least one conductive and inelastic yarn primarily located between outer upper and lower fabric surfaces which is positioned in sinusoidal configurations longitudinally of the fabric. There is provided a breakout of the conductive yarn through an outer surface where exposed ends of the conductive yarns are arranged in opposed positions. A monitoring unit, which includes a connector and a sensor, is secured with the outer surface at the breakout, where the connector is united with the exposed ends of the conductive yarns. The fabric functions to maintain the monitoring unit in a desired stationary position to sense signals emitted from the torso and to transmit these sensed signals to a receiver.

The monitoring unit may include a PC board secured adjacent the surface of the fabric. The PC board includes exposed contacts which are adapted to secure with the exposed ends of the conductive yarns. An insulating pad is positioned between the outer surface and the PC board. The monitoring unit also includes a mounting cap which is adapted to releasably support the monitor. The mounting cap includes engaging members which are adapted to secure with the elastic fabric to lock the mounting cap in position adjacent the surface of the elastic fabric.

Alternatively, the monitoring unit may include one or more electrode sensing units secured with an inner side of the fabric adjacent to or over a breakout. Each monitoring unit is connected with a conductive yarn at the breakout.

On the opposite side of the fabric there is provided an outer side breakout. Each conductive yarn passes through the outer surface of the fabric at the outer side breakout. A connector is attached with the exposed ends of the conductive yarns.

A carrier for a sensor module is connected with the outer side of the fabric adjacent the outer side breakout. The sensor module carried by the carrier is connected with the conductive yarns through the connector.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein:

FIG. 2 is the weave diagram for forming the fabric of the invention.

FIG. 2A is an alternative to the weave diagram of harness 2 in FIG. 2.

FIG. 6 is similar to FIG. 4 showing picks 9–12 of the weft yarn.

FIG. 7 is similar to FIG. 4 showing picks 13–16 of the weft yarn.

FIG. 20A is an exploded perspective view showing the sensing device engaged with the carrier fabric and the conductive yarns.

FIG. 20B is a perspective view of the underside of the sensing element.

DESCRIPTION OF A PREFERRED EMBODIMENT

Systems have now been developed which are capable of sensing and transmitting data from a person's body during activity, which indicates body function. The systems are adapted to individually monitor respiration, pulse rate, skin temperature and blood pressure. The instant invention is directed to the structure of a carrier fabric which, when fitted onto a person's body, acts to remain as positioned and is capable of expanding and contracting and possess antenna capable of transmitting collected data. It is also desired that the carrier fabric be as non-intrusive as possible. The invention also includes a carrier which connects with the carrier fabric and individually with the conductive yarn or yarns of the fabric. The carrier mounts a monitor or sensor in engagement with the conductive yarns.

Figure 1:
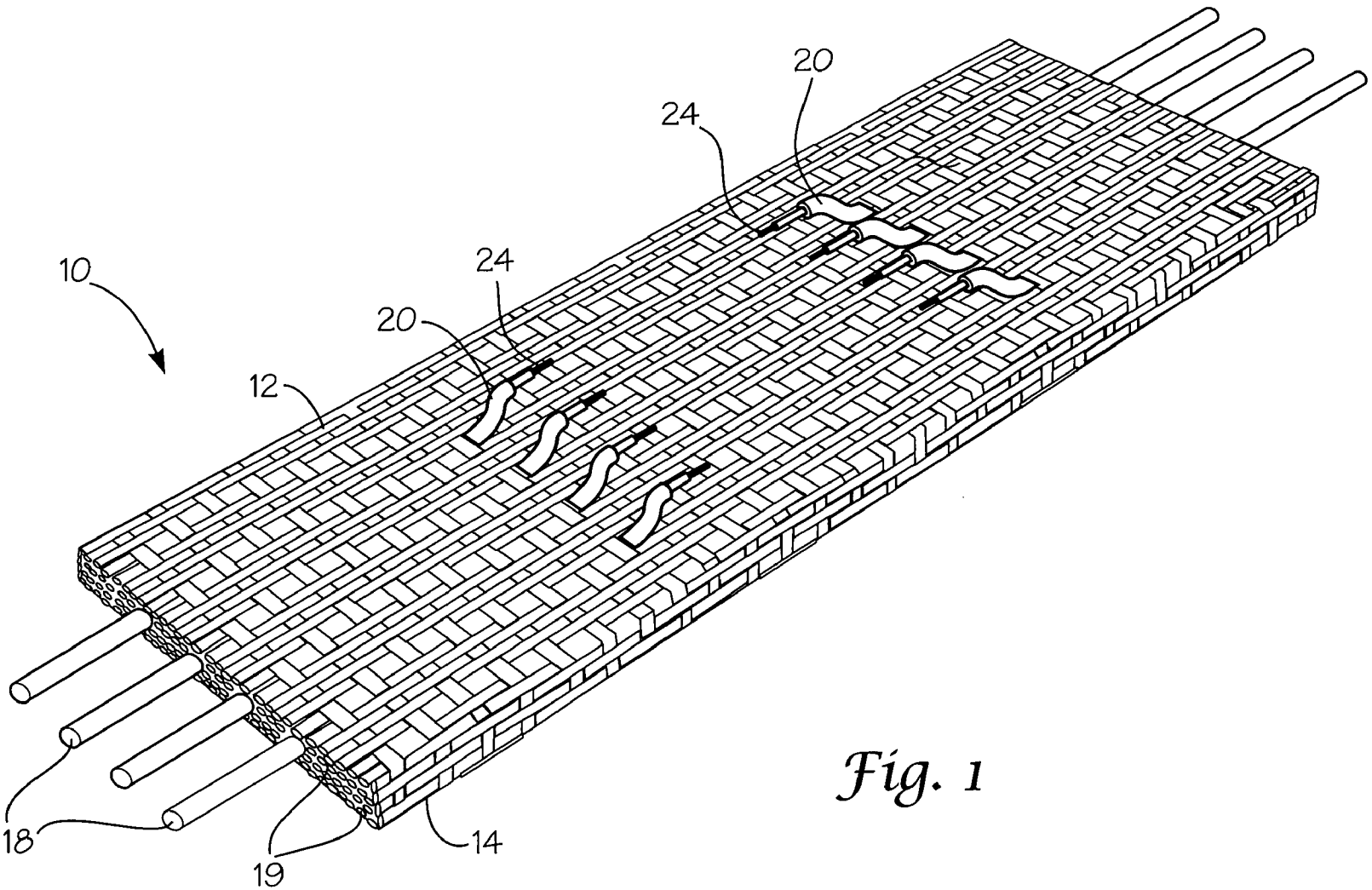
FIG. 1 is a perspective view of the elastic carrier fabric of the invention.

Turning now to FIG. 1 of the drawing, there is shown a section of carrier fabric 10 of the invention. Fabric 10 is a multi-ply fabric having an upper surface or layer 12 and a lower surface or layer 14. The conductive yarns 18 extend along the fabric length between the upper and lower layers within an intermediate layer 19. It is noted that the number of conductive yarns may vary between one and as many as necessary, generally up to six.

Figure 19:
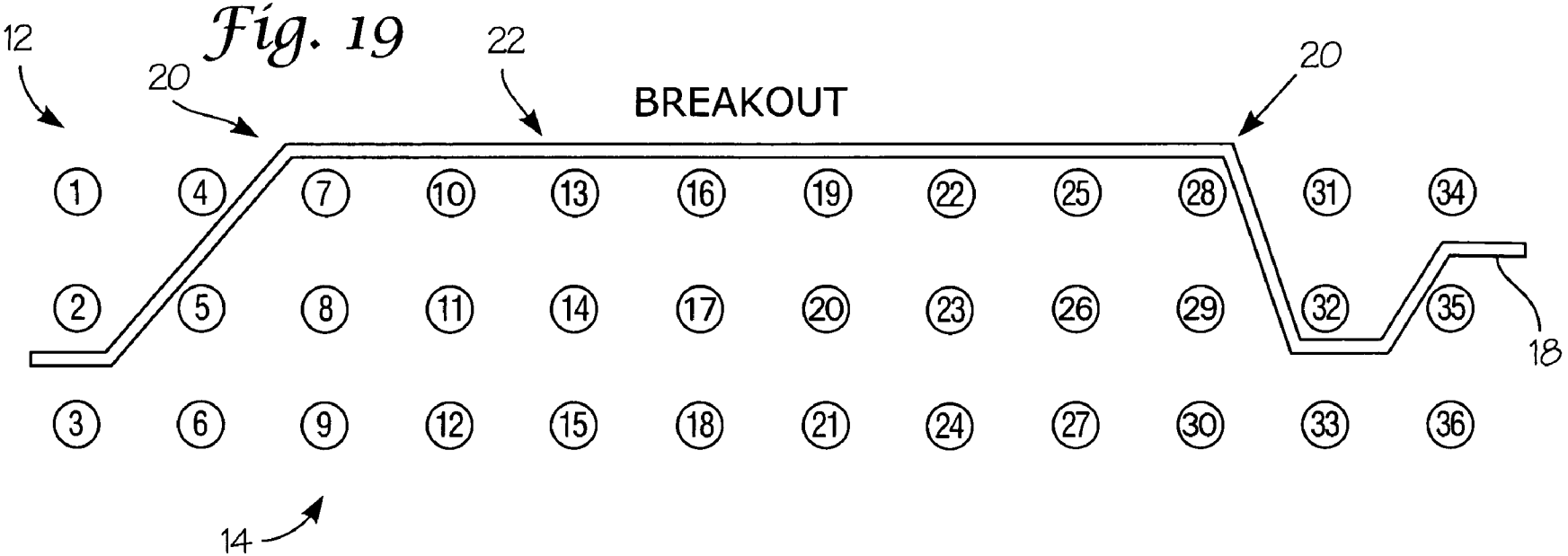
FIG. 19 is a sectional side view showing the position of the conductive yarn at the breakout
Figure 21:
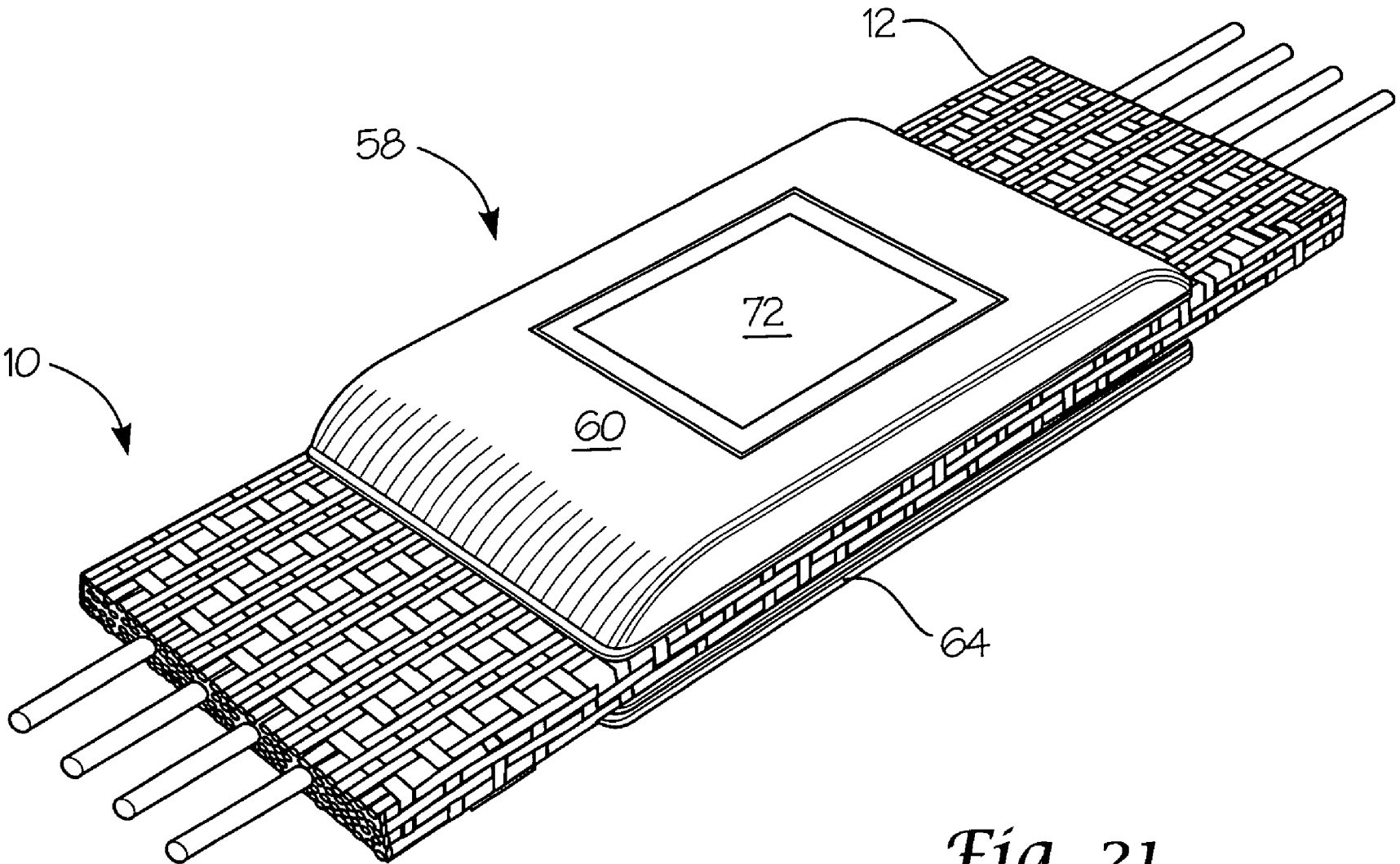
FIG. 21 is a perspective view of the sensing device in position on the carrier fabric.

At selected points along the fabric length, conductive yarns 18 are caused or controlled to breakout of the inner fabric area as shown at 20 and form loops over the outer surface. Loops 22, as shown in FIG. 19, are cut, leaving exposed ends 24 arranged in opposed positions or the cut may leave only one end of each conductive yarn above the fabric surface. Further, it is noted that breakouts may be controlled to occur on both fabric sides at spaced intervals with a selected number of conductive yarns breaking out at each breakout point.

Figures 3, 3A, 3B:
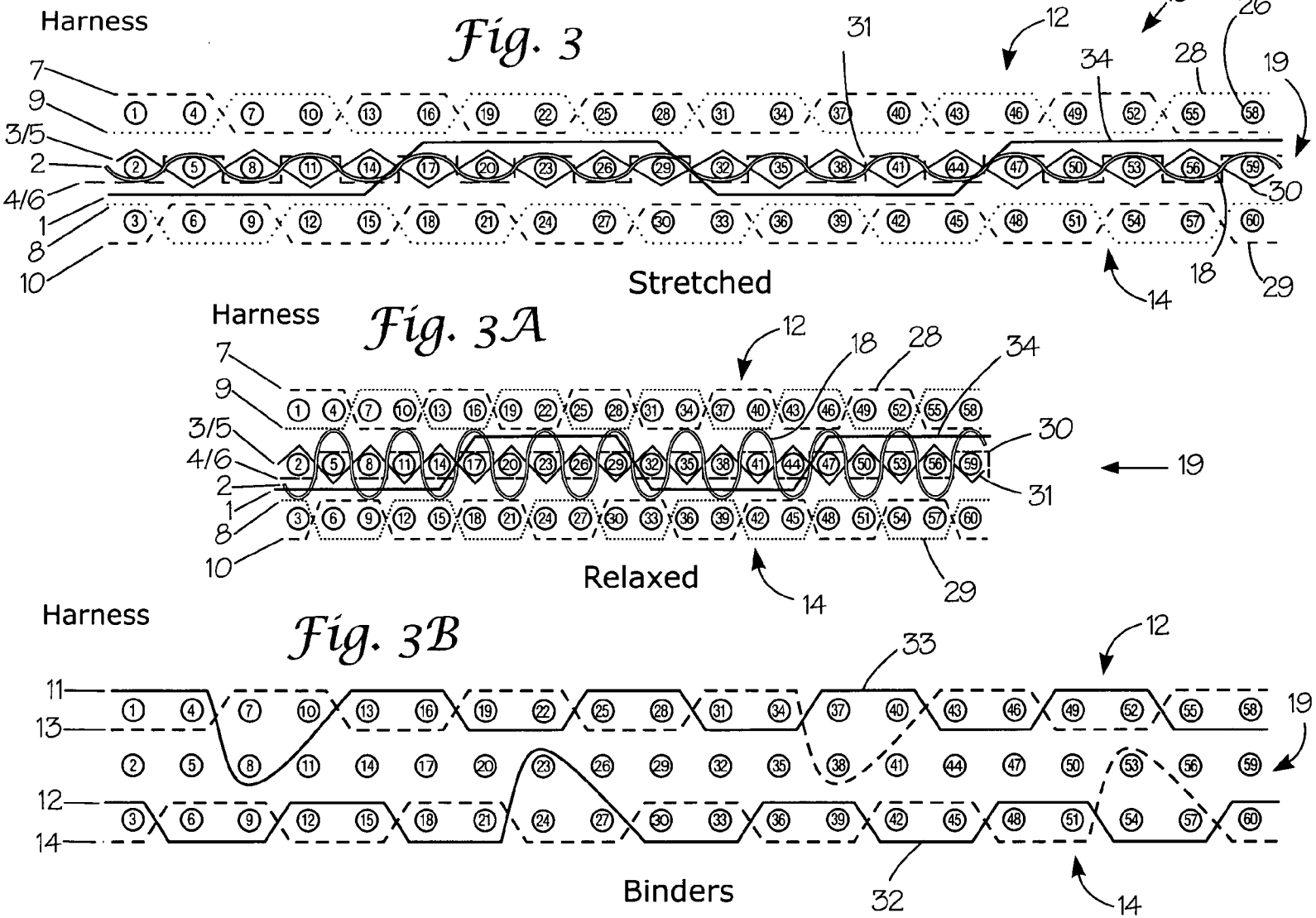
FIG. 3 is a cutaway sectional side view of the weave of the carrier fabric in an elongated condition without the binder warp yarns.
FIG. 3A is a cutaway side view of the fabric of FIG. 3 in its relaxed condition.
FIG. 3B is a cutaway sectional side view showing the binder warp yarns binding the fabric layers together.
Figure 4:
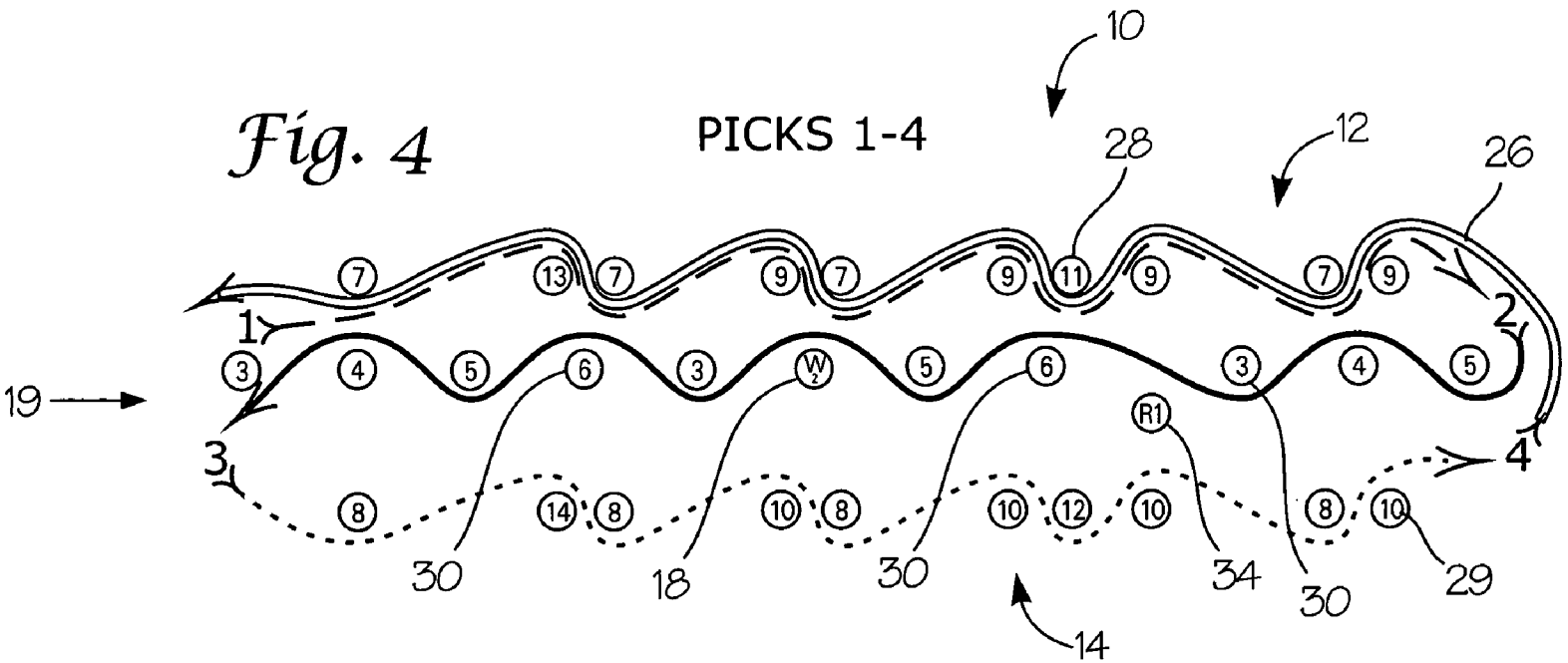
FIG. 4 is a cutaway end view showing picks 1–4 of the weft yarn.
Figure 5:
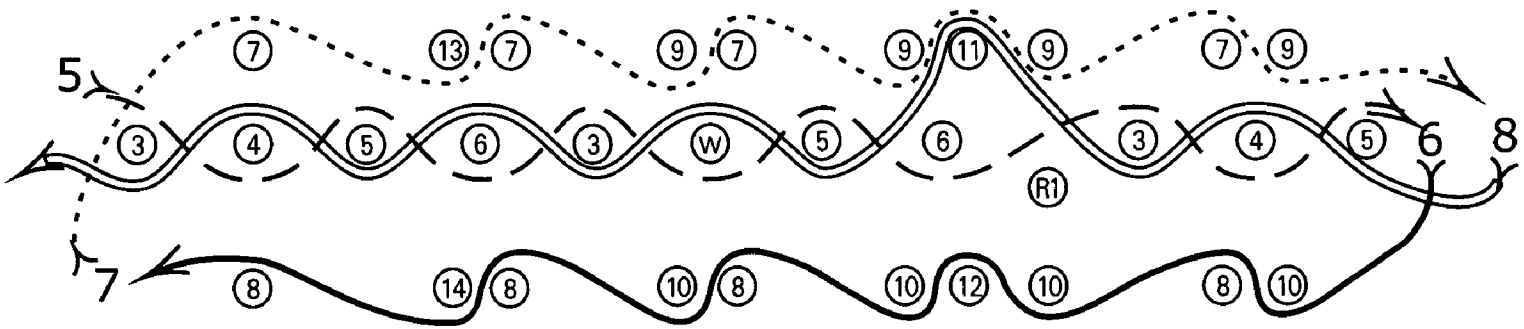
FIG. 5 is similar to FIG. 4 showing picks 5–8 of the weft yarn.
Figure 8:
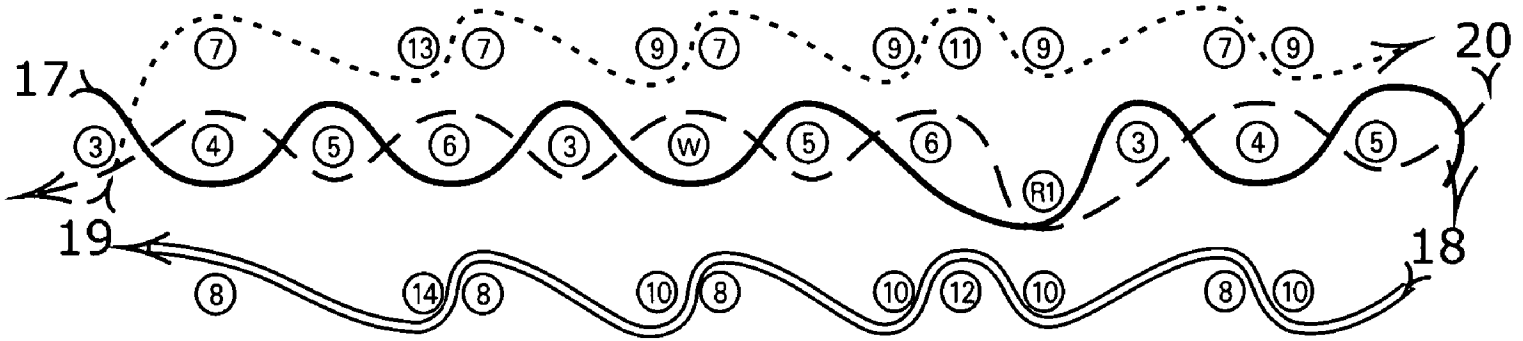
FIG. 8 is similar to FIG. 4 showing picks 17–20 of the weft yarn.
Figure 9:
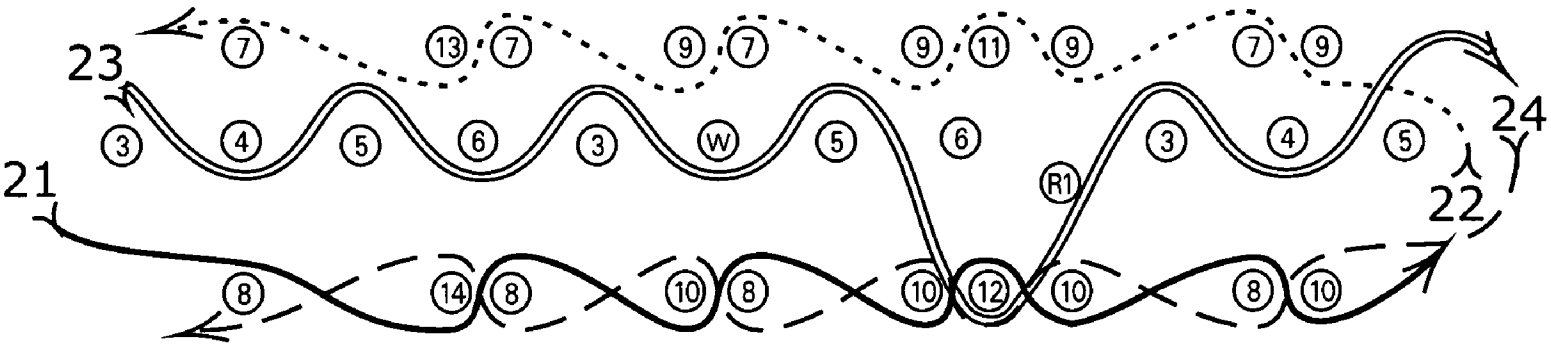
FIG. 9 is similar to FIG. 4 showing picks 21–24 of the weft yarn.
Figure 10:
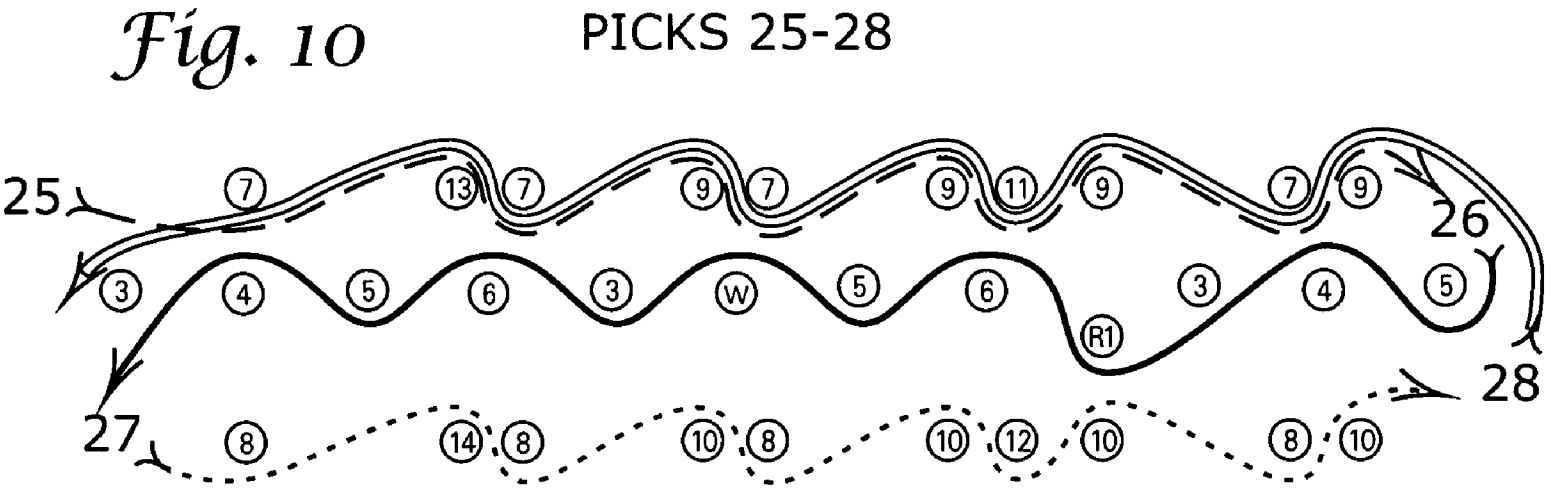
FIG. 10 is similar to FIG. 4 showing picks 25–28 of the weft yarn.
Figure 11:
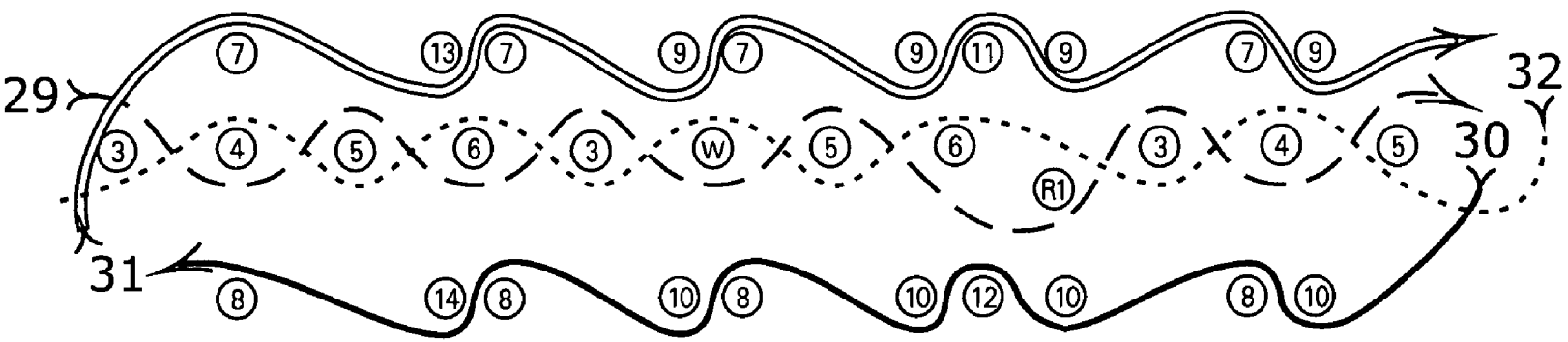
FIG. 11 is similar to FIG. 4 showing picks 29–32 of the weft yarn.
Figure 12:
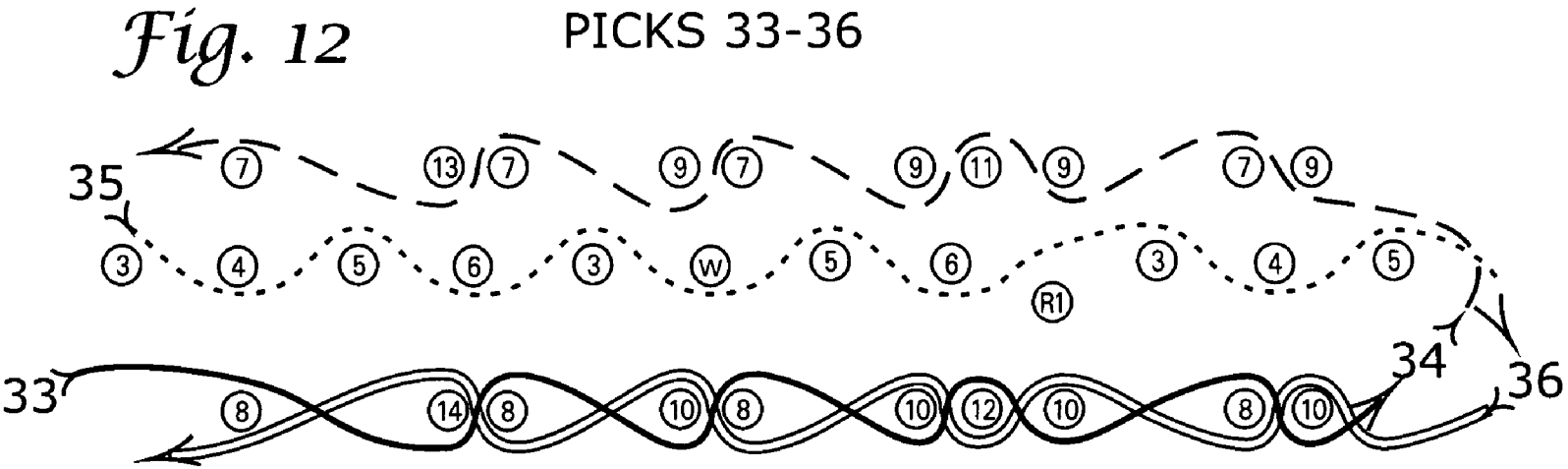
FIG. 12 is similar to FIG. 4 showing picks 33–36 of the weft yarn.
Figure 13:
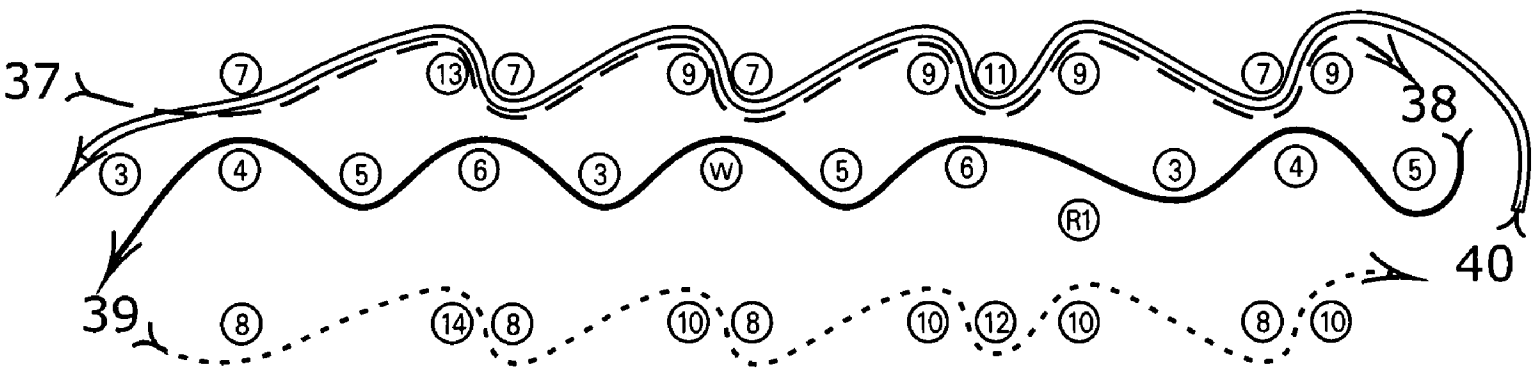
FIG. 13 is similar to FIG. 4 showing picks 34–40 of the weft yarn.
Figure 14:
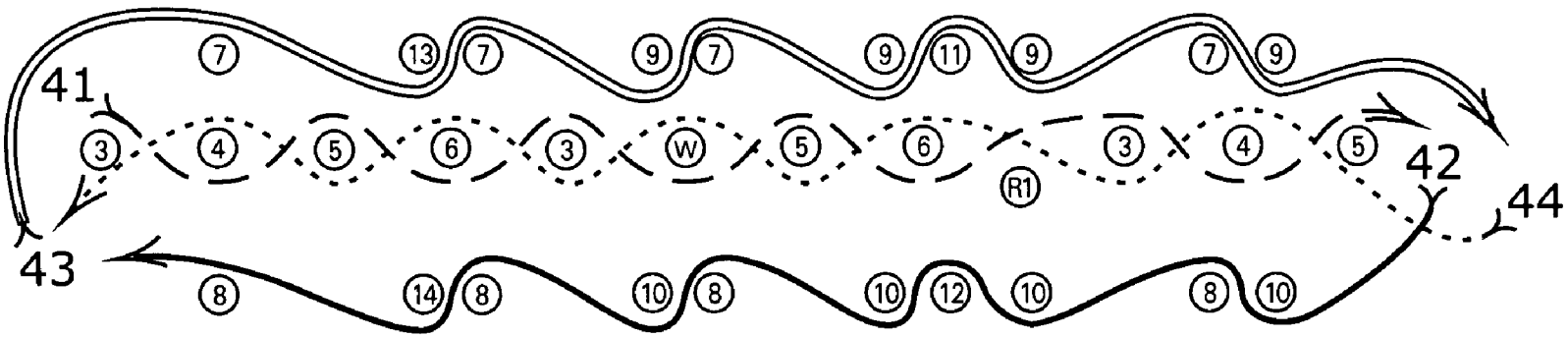
FIG. 14 is similar to FIG. 4 showing picks 41–44 of the weft yarn.
Figure 15:
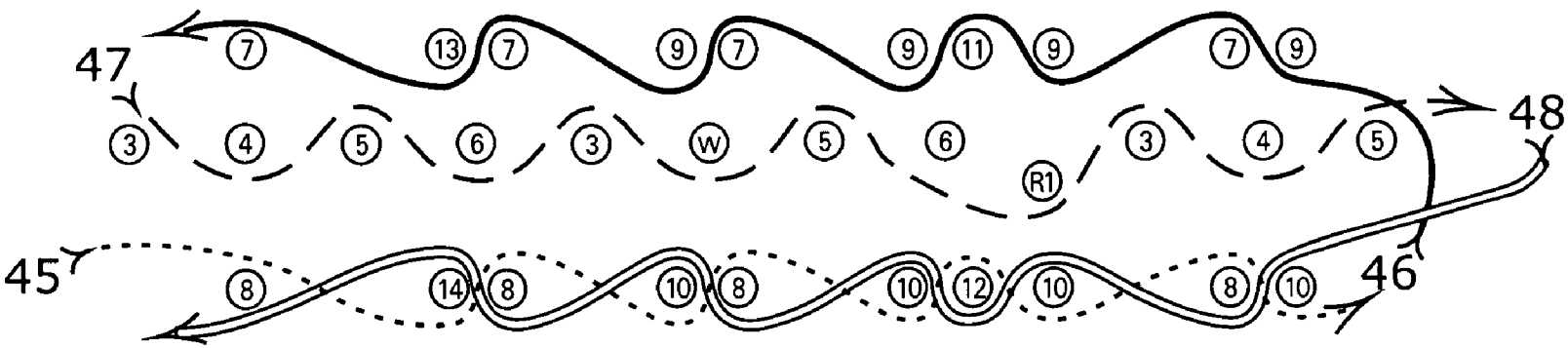
FIG. 15 is similar to FIG. 4 showing picks 45–48 of the weft yarn.
Figure 16:
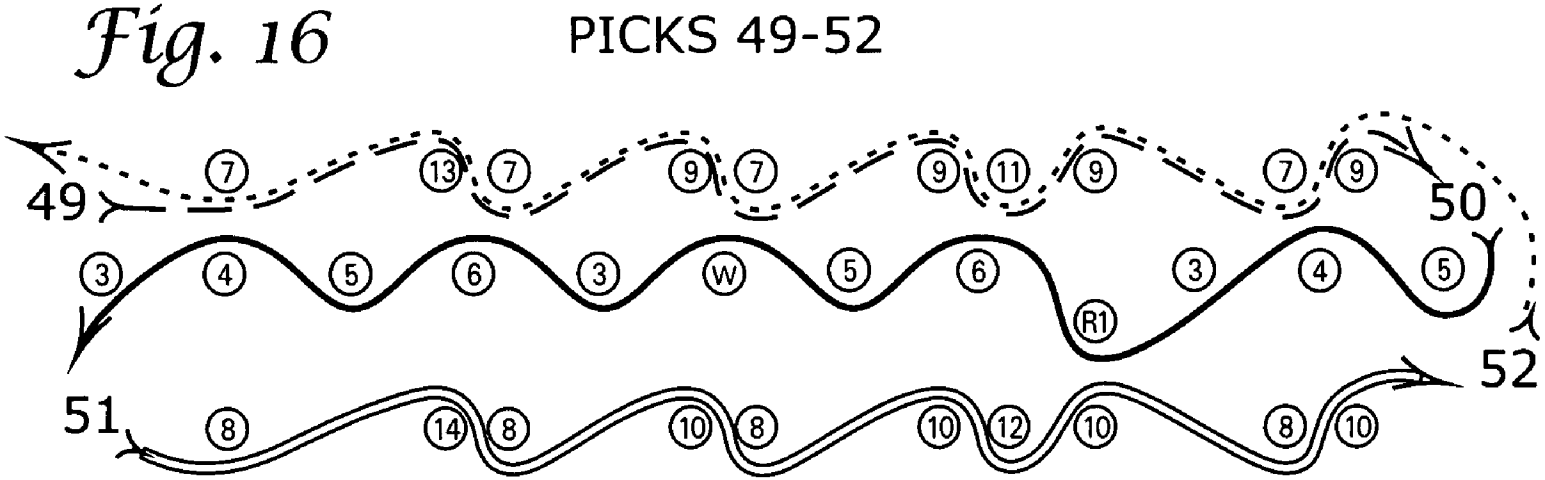
FIG. 16 is similar to FIG. 4 showing picks 49–52 of the weft yarn.
Figure 17:
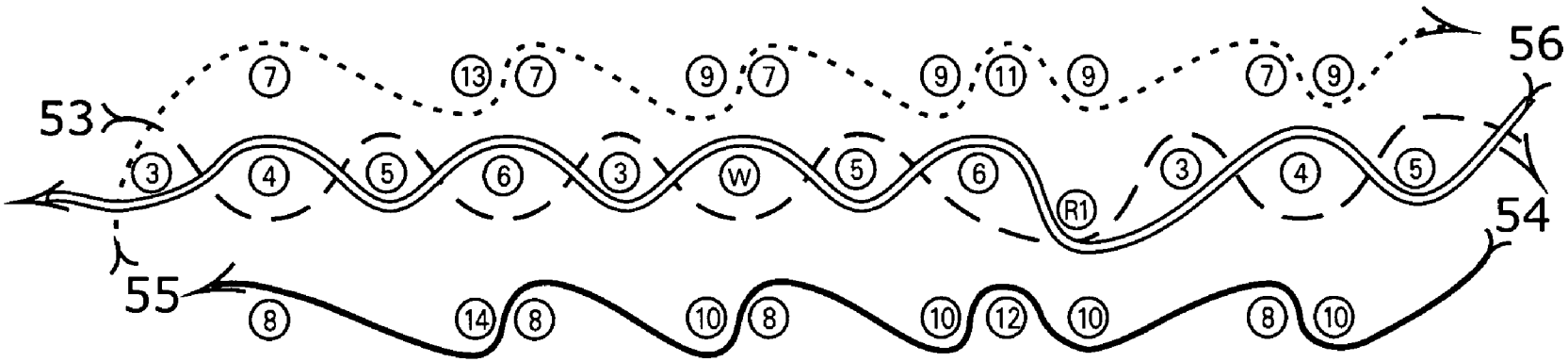
FIG. 17 is similar to FIG. 4 showing picks 53–56 of the weft yarn.
Figure 18:
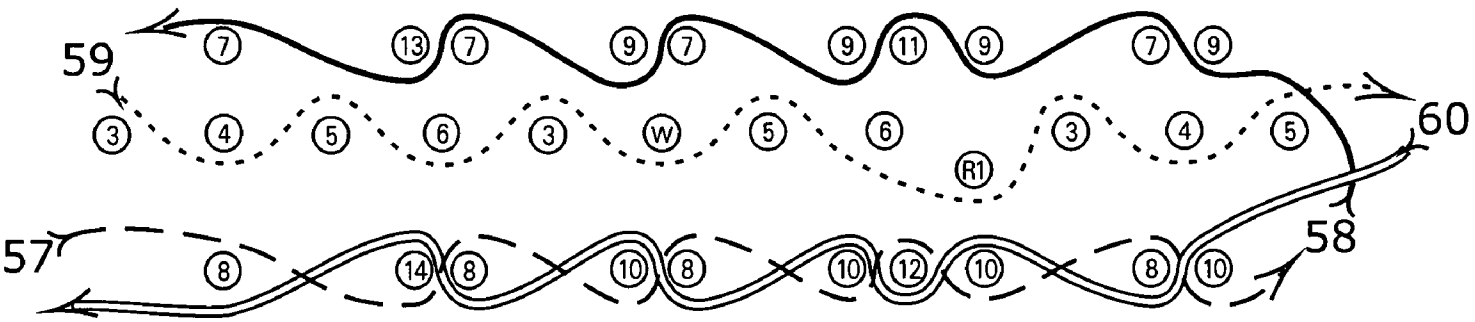
FIG. 18 is similar to FIG. 4 showing picks 57–60 of the weft yarn.

The elastic carrier fabric herein disclosed is woven utilizing the weave diagram shown in FIG. 2. There are thirty-one elastic warp yarns, one of which is rubber or latex, one inelastic conductive wire strand and sixty inelastic picks required for each repeat of the weave pattern. The elastic warp may be textured synthetic, rubber or latex yarns. The diagram identifies the harness or harness frames as 1–14 laterally across the top of the diagram. The picks of weft yarn are identified as 1–60 vertically along the side of the diagram. Harness 1 carries the rubber or latex binder yarn. Harnesses 3 and 5 along with harnesses 4 and 6 carry textured core yarns which are controlled to weave along the intermediate layer in a one up one down pattern as shown in FIG. 3. Harness 2 weaves the same as harnesses 4 and 6 and carries the conductive yarn. The conductive yarn is preferably twenty-four gauge wire, however, other conductive filaments could be used. Harness 1 carries the rubber elastic yarns which weave with the intermediate layer in a floating pattern, as indicated in FIG. 3. Harnesses 7 and 9 carry the warp yarns which weave to form the upper or outer surface while harnesses 8 and 10 carry the warp yarns which weave to form the lower or bottom surface, also shown in FIG. 3. Harnesses 11 and 13 carry the binder yarns which weave with the upper layer and the intermediate layer, while harnesses 12 and 14 carry the binder yarns which weave with the lower layer and the intermediate layer, as shown in FIG. 3B.

As is usual in weave patterns, X indicates a raised harness and a blank or O indicates a lowered harness. The weft yarn passes beneath the warp where the harness is raised and above the warp yarn where the harness is lowered.

As indicated to the left of the harness 14 in FIG. 2A, a supplemental pattern for harness 2 is shown. This supplemental pattern is incorporated or substituted into the weave pattern when it is desired to form a breakout of the conductive yarn. The breakout loop usually runs over a twenty-four pick sequence. As shown, harness 2 is raised on pick 5 and remains raised through pick 30. This carries or causes the conductive yarn to float over picks 5–30. The supplemental pattern may be incorporated into the weave pattern where desired and the length of the breakout may be varied as desired. Alternatively, the breakout could be brought about on the opposite fabric side. In this case, harness 2 could simply be lowered through the indicated picks. Generally, the breakout is as shown in FIG. 19.

A warp wise repeat includes thirty-two warp yarns which comprise the upper and lower, core, binder, rubber and conductive warp. A repeat includes only one rubber and one conductive warp. In practice, the elastic fabric used in the physiological sensing system incorporates a plurality of warp wise and weft wise weave repeats. Preferably, the desired number of conductive yarns is four, as shown in FIG. 1, which comprises four repeats of the weave pattern, which utilizes one hundred twenty-four warp yarns in combination with the four conductive yarns. The number of conductive yarns may be increased or decreased as desired.

Fabric 10, as best shown in FIGS. 3, 3B and 4–18, is woven in a sixty weave pattern utilizing inelastic weft yarn 26, elastic or textured warp yarn 28, 29, 32, 33, textured elastic core warp 30, 31, elastic latex or rubber warp 34 and conductive warp 18. The picks are sequentially numbered 1–60 in FIGS. 3–18 and vertically in FIG. 2. The textured warp yarns are arranged in a plurality of groups with warp yarns 28 being arranged in the upper layer and warp yarns 29 in the lower group. As shown in the drawings, warp yarns 28 and 29 weave only with selected picks to form the upper and lower layers. Warp yarns 30, 31 which are textured yarns, weave only with selected picks to form the intermediate layer.

Warp yarns 33, as shown in FIG. 3B, comprise upper binder yarns which weave primarily with the upper layer 12 and act to tie the upper 12 with the intermediate layer 19. Harness frames 11 and 13 carry the upper binder warp yarns 33 while harness frames 7 and 9 carry the upper warp yarns 28. Warp yarns 29 and 32 form the lower ply in a manner similar to the upper ply with warp yarn 32 weaving as the binder yarns binding the lower layer 14 with the intermediate layer. Harness frames 12 and 14 carry warp yarns 32.

FIGS. 4–18 sequentially show the path of each pick 1–60 as they pass over or under each warp yarn of the weave pattern. The warp yarns are identified by the harness number of the controlling harness. For example, the upper layer warp yarns are carried by harnesses 7, 9, 11 and 13, the intermediate layer warps by harnesses 1, 2, 3, 4, 5 and 6, and the lower layer warps by harnesses 8, 10, 12 and 14.

The intermediate layer is formed of selected picks of the weft yarn 26 weaving with core warp yarns 30, 31 rubber or spandex warp yarns 34, and conductive warp yarns 18. The core warp yarns are carried by harnesses 3–6, the rubber yarn 34 by harness1 and the conductive warp yarn by harness 2. The core yarns comprise a combination of textured polyester yarns 2/200/96 and textured nylon 840/1 which are interspersed across the intermediate layer to be on opposed sides of the conductive yarns 20. The binding created by the weaving of the weft with the core yarns and the conductive yarns causes the conductive yarn to assume sinusoidal positions along a vertical plane as the fabric is woven.

In order to provide a soft or fluffy feel on the outer surface which is intended to engage with the body, at least certain of the outer layer warp yarns are two ply with one ply being highly textured.

As is usual when weaving elastic fabrics, the elastic yarns are put under tension and are elongated during formation of the fabric as is shown in FIG. 3. As the fabric comes off the loom, it contracts as shown in FIG. 3A. In this condition, the picks are drawn closer laterally inward or together as the elastic yarns contract. The sinusoidal configurations of the conductive yarns, controlled by core and weft as above described, are forced into enlarged but controlled sinusoidal configurations during and after contraction. Because conductive yarns 18 are interwoven with the fabric along the intermediate layer, they are maintained in lateral position by the core yarns and are encased between the upper and lower layers. This results in only an upward and downward motion or configuration of the conductive yarns as the size of the sinusoidal configurations are adjusted relative to the fabric length.

Turning now to FIGS. 3, 3A and 3B, fabric 10 is essentially shown as three separate fabrics, upper layer 12, lower layer 14 and intermediate layer 19. These layers, while woven simultaneously on a single loom, are essentially independent fabrics. It is only through binding warp yarns 32, 33 that the independent layers are inter-engaged into a single multi-ply fabric. The binding yarns 32, 33 weave primarily with the upper or lower layers, respectively, each binding with the intermediate layer only on one pick per weave repeat.

In order for fabric 10 to effectively function as a carrier fabric for a monitoring system, breakouts 20 are formed at selected locations along the fabric length. A breakout is where the conductive yarn is brought through upper surface 12 of composite fabric 10 to extend over a length of the fabric before being moved back into the intermediate layer. The manner in which yarn 18 is controlled at a breakout are best shown in FIGS. 2A and 19. The breakout length is generally controlled over a selected length of the weave pattern. The breakout could be longer or shorter than the arrangement shown as desired. At a selected point, which is shown as pick 4, conductive yarn 18 is brought above upper surface 12 to float for a selected distance, in this instance to pick 28. All other warp yarns weave as earlier described with picks 1–30 of the weft yarn. The picks normally weaving with the conductive yarn simply float in the intermediate layer in the area normally occupied by the conductive yarns and continue to weave with the core warp yarns. The breakouts may occur on only one fabric side, on alternating fabric sides and with between all to only one conductive yarn breaking out at each breakout.

With fabric 10 formed to a desired length and width and with loops 22 formed at selected locations, each loop is cut and the opposed ends of each conductive yarn 18 is stripped leaving exposed ends 24 as shown in FIGS. 1 and 20A. PC board 52 is positioned on surface 12 of the fabric in position for stripped ends 24 to be engaged with contacts 54 as shown in FIGS. 20A and 20B. Preferably, an insulating pad 56 is positioned between surface 12 and board 52. A carrier 58, is attached to both PC board 52 and fabric 10, locking the PC board in position.

In the instant arrangement, carrier 58 comprises an upper plate 60 with a plurality of pegs 62 extending from its lower surface. Lower plate 64 is positioned against lower surface 14 of fabric 10 and includes openings 66, which are adapted to receive pegs 62 of upper plate 60. To lock the PC board with surface 12 of the fabric, pegs 62 are passed through the openings in the PC board, through fabric 12 and are secured in openings 66 of lower plate 64. This locks the carrier with fabric 12 with PC board 52 interconnected with conductive yarns 18.

Upper plate 60 of carrier 58 includes central opening 68, which is adapted to releasably receive and secure monitor 72 in position to engage with PC board 52. Monitor 72 includes contacts 70 on its lower surface which are positioned to engage with contacts 54 of PC board 52 connecting monitor 72 with conductive yarns 44. Retractable snaps 74, of usual construction, are pressure fit with grooves 76 to maintain monitor 72 engaged with upper plate 60 of carrier 58 and in position relative PC board 52. Other known releasable engagement structures may be utilized, if desired, to releasably position the monitor within opening 68.

Figure 22:
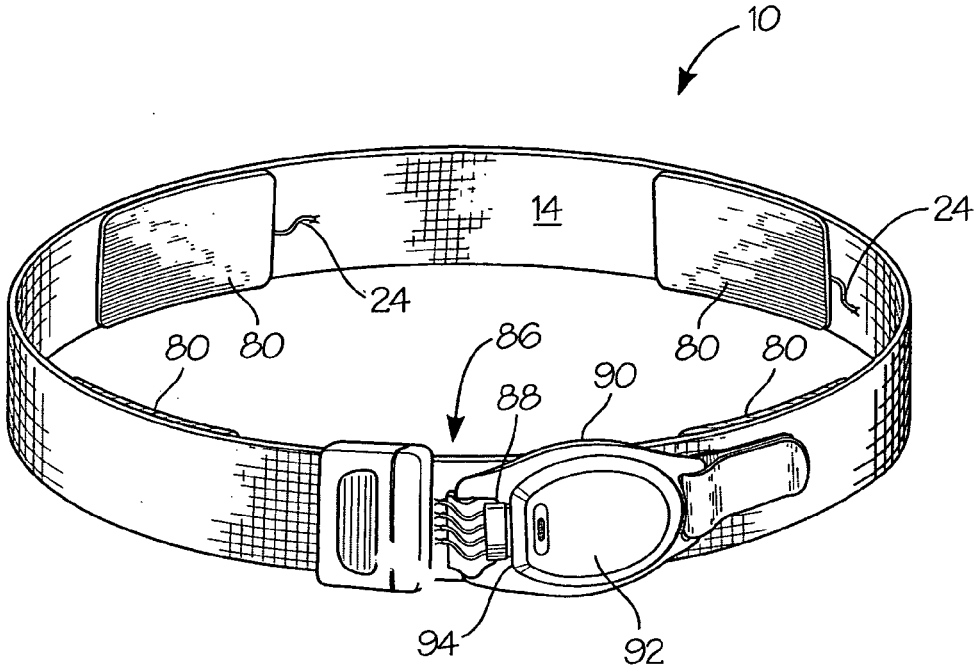
FIG. 22 is a perspective view of a second arrangement wherein sensing electrodes are attached with the carrier fabric on a first side and the sensor module is attached with the carrier fabric on the opposite side.
Figure 23:
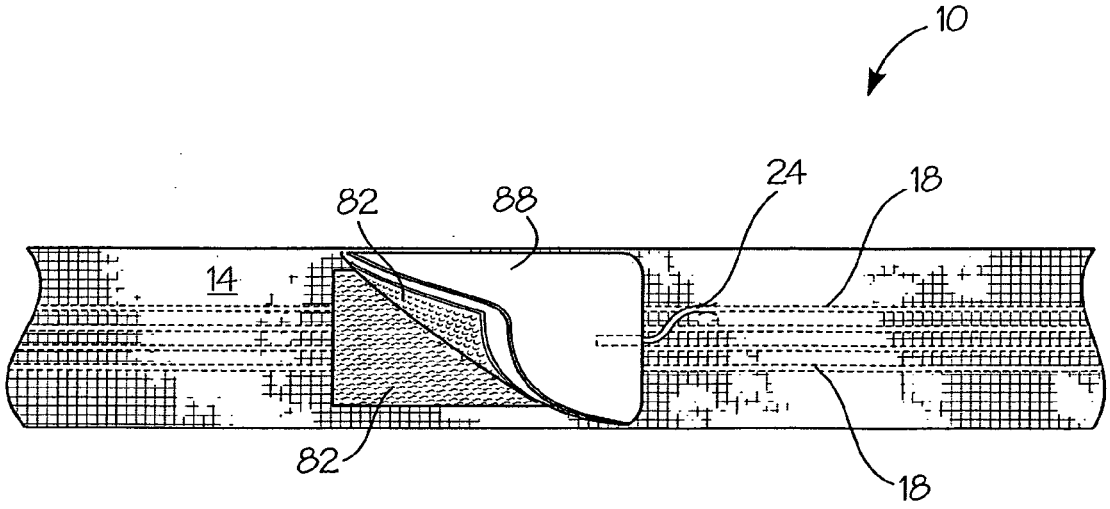
FIG. 23 is a perspective view of an alternative arrangement in which a sensing electrode is secured to the fabric with hook and loop connectors.

In another arrangement, best seen in FIGS. 22 and 23, at least one sensing element 80, which is in the form of an electrode, is secured with inner side 14 of belt 10. Preferably, a strip 82 of hook and loop connector is secured with side 14 of fabric 10 by any suitable means, i.e. heat welding, stitching, etc. A mating strip 82 of hook and loop connector is secured with a side of sensing element 80. Strips 82 are inter-engaged securing sensing element 80 with side 14 of fabric 19. An end 24 of a single conductive wire 18 is inserted into a receptacle of sensing element 80 as shown in FIG. 23. The receptacle may be located adjacent or away from fabric 10.

Fabric 10 is shown in FIG. 22 in the form of a belt complete with four sensing elements 80 secured to the inner belt side. Associated with each sensing element 80 is a single conductive yarn 24. It is noted that the conductive yarns 18 providing the four exposed ends 24 are arranged along spaced planes across fabric 10 breaking out at first locations longitudinally spaced providing an individual conductive yarn for connection with each sensing element 80.

Each of the conductive yarns 18 again break out of fabric 10 at 86 adjacent receptacle 88 to which they are attached. Carrier 90 is secured with fabric 10, by any suitable connector, adjacent breakout 86. Monitoring sensor or unit 92, which may be in any desired configuration, is adapted to engage in a mating opening formed centrally of carrier 90 by any known means in a removably secured manner. Receptacle 94, formed with monitor 92, is positioned to be engaged with receptacle 88, interconnecting sensing elements 80 with monitor 92. In the condition shown, the monitoring unit may monitor a single body function or a plurality of body functions. It is noted receptacles 88 and 94 are one of the projection/cavity type which are well known.

In use, fabric 10, arranged as a circular band, is positioned about a selected body or torso area in extended position with monitor 72 or sensing elements 80, positioned adjacent the body or only with electrode sensor 80 so positioned. The electrode sensors 80 are connected with a monitor 92 as above described. The extended position allows the elastic warp yarns, which are attempting to contract, secure the fabric carrying the monitor or sensor in a fixed position with the body while still allowing the fabric to expand and contract due to body movement. Monitor 72, or electrode sensor 80 and monitor or unit 92, which form no part of the instant invention, are of known construction and may be of any convenient or suitable size or configuration. The monitors 72, 92 act to detect sensings from one or more body functions. These signals are then computed, recorded or transmitted to a distant receiver using the conductive yarns as antenna. The monitor or module may send the signals as received or it may compute the signals into data which are then sent to the distant receiver or they may perform other known functions.

While a preferred embodiment of the invention has been described using specific terms, such description is for illustrative purposes only, and it is to be understood that changes and variations may be made without departing from the spirit or scope of the following claims.

What is claimed is:

1. An elastic multi-ply woven fabric stretchable from a retracted position into a plurality of elongated positions for use in a physiological sensing system comprising:

a plurality of upper and lower textured elastic warp yarns arranged in vertically spaced positions;

a plurality of elastic warp yarns arranged in transversely spaced positions along an intermediate plane;

at least one inelastic conductive warp yarn extending longitudinally of said fabric in said intermediate plane between said upper and lower warp yarns, said conductive yarn being arranged in controlled sinusoidal configurations;

a plurality of textured elastic core warp yarns extending longitudinally of said fabric along said intermediate plane in transversely spaced positions along opposing sides of said conductive warp yarn;

a plurality of picks of inelastic weft yarn, first ones of said picks weaving with said upper warp yarns and second ones of said picks weaving with said lower warp yarns forming vertically spaced upper and lower outer surfaces across said fabric;

third ones of said picks weaving with said at least one conductive warp yarn, said elastic warp yarns and said core warp yarns between said upper and lower outer surfaces forming an intermediate layer, said third ones of said picks and said core warp yarns and said elastic warp yarns positioning said conductive warp yarn in fixed longitudinal position along said intermediate layer and in sinusoidal configurations of said controlled sinusoidal configurations; wherein, said fabric may be extended longitudinally by between about 25% and 125% from its said retracted position into various of said elongated positions causing said controlled sinusoidal configurations of said conductive yarns to be altered consistent with the degree of said extension.

2. The elastic fabric of claim 1 wherein said sinusoidal configurations are controlled to extend along a single plane by said core yarns, said elastic yarns and said second ones of said picks.

3. The elastic fabric of claim 1 including binder upper and lower warp yarns weaving with said upper and lower surfaces binding said upper and lower surfaces with said intermediate layer.

4. The multi-ply woven fabric of claim 1 wherein said elastic warp yarns include yarns having a spandex core wrapped with a textured polyester yarn.

5. The multi-ply woven fabric of claim 1 wherein selected said elastic yarns include a spandex core of about 420 denier.

6. The multi-ply woven fabric of claim 1 wherein certain of said elastic wrap yarns comprise textured synthetic multi-filament yarns.

7. The multi-ply woven fabric of claim 1 further including at least one breakout point where said at least one conductive warp yarns is caused to extend over one of said upper and lower surfaces for a selected distance to form a connector loop.

8. The multi-ply woven fabric of claim 7, including a plurality of said conductive yarns and a plurality of breakout points, where individually said plurality of conductive yarns extend over selected spaced distances of at least one of said upper and lower surfaces.

9. The multi-ply woven fabric of claim 7 wherein there are up to six conductor yarns each forming a connector, said connectors being arranged in spaced longitudinal positions along said fabric surface.

10. The multi-ply woven fabric of claim 1 wherein said fabric is woven in a 60 pick repeating pattern.

11. The multi-ply woven fabric of claim 1 wherein there are at least six conductive warp yarns per weave pattern repeat.

12. The multi-ply woven fabric of claim 11 wherein said conductive yarns are located between core yarns.

13. The multi-ply woven fabric of claim 1 wherein said at least one conductive yarn comprises a wire filament core encased with a non-conductive cover.

14. The multi-ply woven fabric of claim 1 wherein said elastic yarns are arranged in spaced pairs across said fabric.

15. The multi-ply woven fabric of claim 1 wherein a single of said elastic yarns is arranged along each edge of said fabric.

16. The multi-ply woven fabric of claim 1 wherein said elastic yarns are controlled to float over and under a plurality of said third ones of said picks along said intermediate layer.

17. A multi-ply carrier fabric for use in a physiological sensing system comprising:

first, second and third elastic warp yarn groups each interwoven with selected ones of a plurality of picks of weft yarn in a weave pattern forming said fabric with a plurality of longitudinally extending layers;

said first warp yarn group weaving with first ones of said picks forming an upper layer of said layers;

said second warp yarn group weaving with second ones of said picks forming a lower layer of said layers;

said third warp yarn group being arranged between said first and second warp yarn groups and weaving with third ones of said picks forming an intermediate layer; said third warp yarn group including rubber and conductive yarns arranged in spaced positions across said fabric, said conductive yarns being controlled into sinusoidal configurations;

upper and lower binder warps weaving with said upper and lower layers, said binder warps also weaving with said intermediate layer binding said layers together; wherein said sinusoidal configuration provides that said conductive yarn be of sufficient length to move longitudinally with said fabric when expanded and contracted.

18. An elastic multi-ply woven fabric stretchable from a retracted position into a plurality of elongated positions for use in a physiological sensing system comprising:

a plurality of upper and lower textured elastic warp yarns arranged in vertically spaced positions forming upper and lower outer surfaces;

a plurality of upper and lower elastic warp binder yarns arranged in transversely spaced positions;

a plurality of inelastic conductive warp yarns arranged in an intermediate plane between said upper and lower outer surfaces, said conductive yarns being arranged in controlled sinusoidal configurations;

a plurality of textured elastic core warp yarns extending longitudinally of said fabric in said intermediate plane in transversely spaced positions adjacent opposing sides of said conductive warp yarns, said core warp yarns assisting to maintain said conductive warp yarns in spaced sinusoidal positions;

a plurality of picks of weft yarn, first ones of said picks weaving with said upper warp yarns and said warp binder yarns, second ones of said picks weaving with said lower warp yarns and said binder warp yarns, third ones of said picks weaving in said intermediate plane with said conductive yarns, said core warp yarn and said binder warp yarns, forming said fabric of vertically spaced upper, intermediate and lower layers, united by said binder yarns; wherein said fabric may be extended longitudinally up to 100% from its retracted position into various of said elongated positions causing said controlled sinusoidal configurations of said conductive yarns to be altered consistent with the degree of said extension.

19. The fabric of claim 18 wherein said weft yarn is inelastic.

20. The fabric of claim 18 wherein said third ones of said picks of said weft yarn assists with said core yarn in shaping said conductive yarns into said sinusoidal shapes.

21. The fabric of claim 18 wherein said fabric includes break-out points at selected longitudinal locations where said conductive yarns extend above and float over selected distances of said outer surface.

22. The fabric of claim 18 wherein said binder warp yarns comprise textured polyester.

23. The fabric of claim 18 wherein said weft yarn is polyester.

24. The fabric of claim 18 wherein said conductive yarns comprise coated wire strands.

25. The fabric of claim 24 wherein said wire strands are 24 gauge.

26. The fabric of claim 18 wherein there are six conductive yarns per weave repeat.

27. A system for monitoring prescribed body functions comprising:

a belt worn over a portion of a torso, said belt comprising a woven, multi-layer composite elastic fabric stretchable in its longitudinal direction so as to expand and contract in response to body movement and size;

said fabric including at least one conductive and inelastic yarn located between inner and outer layers of said belt and positioned in sinusoidal configurations longitudinally thereof;

a breakout of said at least one conductive yarn through at least one of said inner and outer layers positioning exposed ends of said at least one conductive yarn outward of said one layer adjacent its outer surface;

a monitor united with said woven elastic fabric adjacent said at lest one breakout, said monitor being united with at least one of said exposed ends of said conductive yarn at said at least one breakout; whereby, said belt maintains said monitoring unit in a desired stationary position about said portion of said torso to sense signals emitted from said torso and to transmit said sensed signals.

28. The system of claim 27 including a PC board secured with said inner layer of said fabric, said PC board having exposed contacts adapted to secure with said exposed end of said at least one conductive yarn, said monitor engaging with said exposed contacts.

29. The system of claim 27 including an insulating pad positioned between said inner surface and said PC board.

30. The system of claim 27 wherein said belt includes at least three of said conductive yarns arranged in spaced positions between said upper and lower layers across said fabric and forming said breakouts through said one layer adjacent its said outer surfaces.

31. The system of claim 30 wherein said system for monitoring includes a carrier adapted to releasably support said monitor, said carrier being secured adjacent breakout on said outer surface of said elastic fabric.

32. The system of claim 30 wherein said breakouts on said inner surface of said elastic fabric are longitudinally spaced, a sensing element having a connector secured with said inner surface adjacent each said inner breakout being connected with said conductive yarn.

33. The system of claim 30 wherein said system for monitoring includes a plurality of sensing elements for sensing body activity arranged in spaced position along said inner surface of said fabric and a monitor for receiving signals from each said sensing element arranged on said outer surfaces of said fabric.

34. The system of claim 33 including a carrier secured with said outer surface of said fabric, said carrier removably supporting said module.

* * * * *